United States Patent [19]

Richter et al.

[11] Patent Number: 4,545,317

[45] Date of Patent: Oct. 8, 1985

[54] DEVICE FOR TREATING THE SURFACES OF STRUCTURES AND SHIPS

[75] Inventors: Uwe Richter, Lüneburg; Hans Kellershofen, Hamburg, both of Fed. Rep. of Germany

[73] Assignees: GKSS-Forschungszentrum Geesthacht GmbH, Geesthacht-Tesperhude; H. Lorenz GmbH, Hamburg, both of Fed. Rep. of Germany

[21] Appl. No.: 445,498

[22] PCT Filed: Mar. 29, 1982

[86] PCT No.: PCT/DE82/00070

§ 371 Date: Nov. 30, 1982

§ 102(e) Date: Nov. 30, 1982

[87] PCT Pub. No.: WO82/03346

PCT Pub. Date: Oct. 14, 1982

[30] Foreign Application Priority Data

Apr. 1, 1981 [DE] Fed. Rep. of Germany ..... 3113028

[51] Int. Cl.[4] ..... B63B 59/08

[52] U.S. Cl. ..... 114/222; 51/438; 51/439; 118/305; 118/712; 239/589

[58] Field of Search ..... 239/346, 589, 654; 114/222; 51/410, 427, 436, 438, 439; 118/305, 712

[56] References Cited

U.S. PATENT DOCUMENTS

| | | | |
|---|---|---|---|
| 2,583,726 | 1/1952 | Chalom | 51/317 |
| 2,666,279 | 1/1954 | Chalom | 51/439 |
| 3,070,924 | 1/1963 | Hastrup | 51/438 X |
| 3,256,642 | 6/1966 | Fonti | 51/427 |
| 3,323,257 | 6/1967 | Fonti | 51/410 |
| 4,209,952 | 7/1980 | Odds | 51/438 |

FOREIGN PATENT DOCUMENTS

| | | | |
|---|---|---|---|
| 960172 | 4/1950 | France | 51/439 |
| 392826 | 5/1933 | United Kingdom | 51/439 |

*Primary Examiner*—Sherman D. Basinger
*Attorney, Agent, or Firm*—Becker & Becker

[57] ABSTRACT

A device for treating the surfaces of structures and ships, even under water, with a spray medium which cleans, preserves, or coats, and is sprayed onto the surface which is to be treated by way of a pressurized gas flow via an at least partially flexible conduit which leads to the work location and is provided with an outlet nozzle. The outlet nozzle, which is constructed as a Laval nozzle, is provided with a funnel-shaped nozzle adapter which has a longitudinally extending, parabolic inner chamber. A controllable shunt, capable of bypassing the spray medium source may be provided for the pressurized gas between the pressurized gas source and the line leading to the outlet nozzle so that the device can be used under water.

6 Claims, 2 Drawing Figures

DEVICE FOR TREATING THE SURFACES OF STRUCTURES AND SHIPS

The present invention relates to a device for treating the surfaces of structures and ships, even under water, with a spray medium which cleans, preserves, or coats, and is sprayed onto the surface which is to be treated by means of a pressurized gas flow via an at least partially flexible conduit which leads to a work location and is provided with an outlet nozzle.

BACKGROUND OF THE INVENTION

1. Field of Invention

Compressed-air spraying as a free-jet air blast is a reliable method for surface treatment with spray material. The method requires a compressor as a source of compressed air, a compressed-air drier, a compressed-air filter, a spray medium container for metered supply of the spray medium, and a hose line having a nozzle, which is generally a Laval nozzle. The performance or efficiency of the method is determined by the parametric field of the air-delivery volume of the compressor as a function of the necessary final pressure, spray medium flow rate, hose length, pressure ahead of the nozzle, and nozzle size.

When it is a question of cleaning and roughening surfaces with only a single application of the spray medium, typical operating values under normal conditions are: 8 mm nozzle diameter; 250 mm spacing from the surface of the spray material; and 80 mm spray-spot diameter, corresponding to approximately 5000 $mm^2$ spray surface. The rate of flow of spray medium depends upon the required surface quality. Naturally, less spray medium is required for cleaning than for attaining a clean metallic surface having a certain peak-to-valley height.

Experience has shown that the effectiveness, i.e., the capacity for doing work, of the spray medium flow decreases very rapidly along the path between the nozzle outlet and the surface to be treated since the supersonic-flow rate is decreased very rapidly to the subsonic range. The theoretically most favorable working distance from zero cannot be realized in practice, since the spray spot cannot be permitted to fall below a critical small surface. This, however, corresponds to a working distance over the length of which the undesired spray speed reduction already occurs.

2. Description of the Prior Art

The foregoing drawback is even more pronounced when working in or below water. Still further drawbacks are as follows:

1. After acceleration in the Laval nozzle, the spray medium enters a medium which in many cases has a higher density. Consequently, the accelerated spray medium very quickly decreases in speed, so that the spray medium has hardly any effect when it encounters the surface to be treated if a water gap exists between the nozzle outlet and the surface to be treated.

2. It is only possible to perform work by a slanted application of the Laval nozzle directly on the surface; in this way the spray spot diameter equals the nozzle diameter. For an 8 mm nozzle, the spray surface under water is only approximately 50 $mm^2$, and a selected surface quality having a certain peak-to-valley height cannot be attained under these conditions.

3. A counterpressure which increases proportionally to depth of application occurs in the Laval nozzle.

The foregoing drawbacks result not only when treating a surface with the cleaning spray medium, but also when treating surfaces with protective or coating spray medium.

SUMMARY OF THE INVENTION

It is an object of the present invention to provide an improved device which, proceeding on the basis of the foregoing indicated state of the art, makes it possible to employ such spray methods with higher efficiency.

This object is fulfilled according to the present invention in that the outlet nozzle which is constructed as a Laval nozzle, is provided with a funnel-shaped nozzle adapter which has a longitudinally extending, parabolic inner space or chamber.

Tests of the device according to the present invention show a considerably higher effectiveness, apparently caused by increased spray velocity.

When the inventive device is used under water, the length of the nozzle adapter may correspond essentially to the required working distance between the nozzle and the surface which is to be treated.

According to a further development of the present invention for underwater use, it is inventively proposed to provide an additional controllable or regulatable shunt for the pressurized gas; this shunt would bypass the spray medium source and would be provided between the pressurized gas source and the line which leads to the outlet or discharge nozzle and hence to the surface which is to be treated.

The shunt provided according to the present invention can be controlled or regulated in such a way that even during times without spray medium supply, the line which leads to the underwater work location, and the nozzle, can be kept dry and free of water. A relatively small overpressure is sufficient for the pressurized gas conveyed via the shunt; this overpressure assures that the pressurized gas at all times bubbles out at the free end of the outlet or discharge nozzle, thereby preventing the water from entering.

According to further specific features of the present invention, the controllable shunt may be provided with a control line which leads to the underwater work location, and with a pressure gauge which detects the water pressure and keeps the pressurized gas delivered via the shunt at a pressure which is greater than the water pressure. A remote control means, which may include a switch, a signal line, and a control unit, may be provided in the pressurized gas flow at the underwater working location for the spray medium delivery.

A preferred embodiment of the present invention, for use under water, is illustrated by way of example in the following with the aid of the attached drawings.

DETAILED DESCRIPTION

Figure 1:
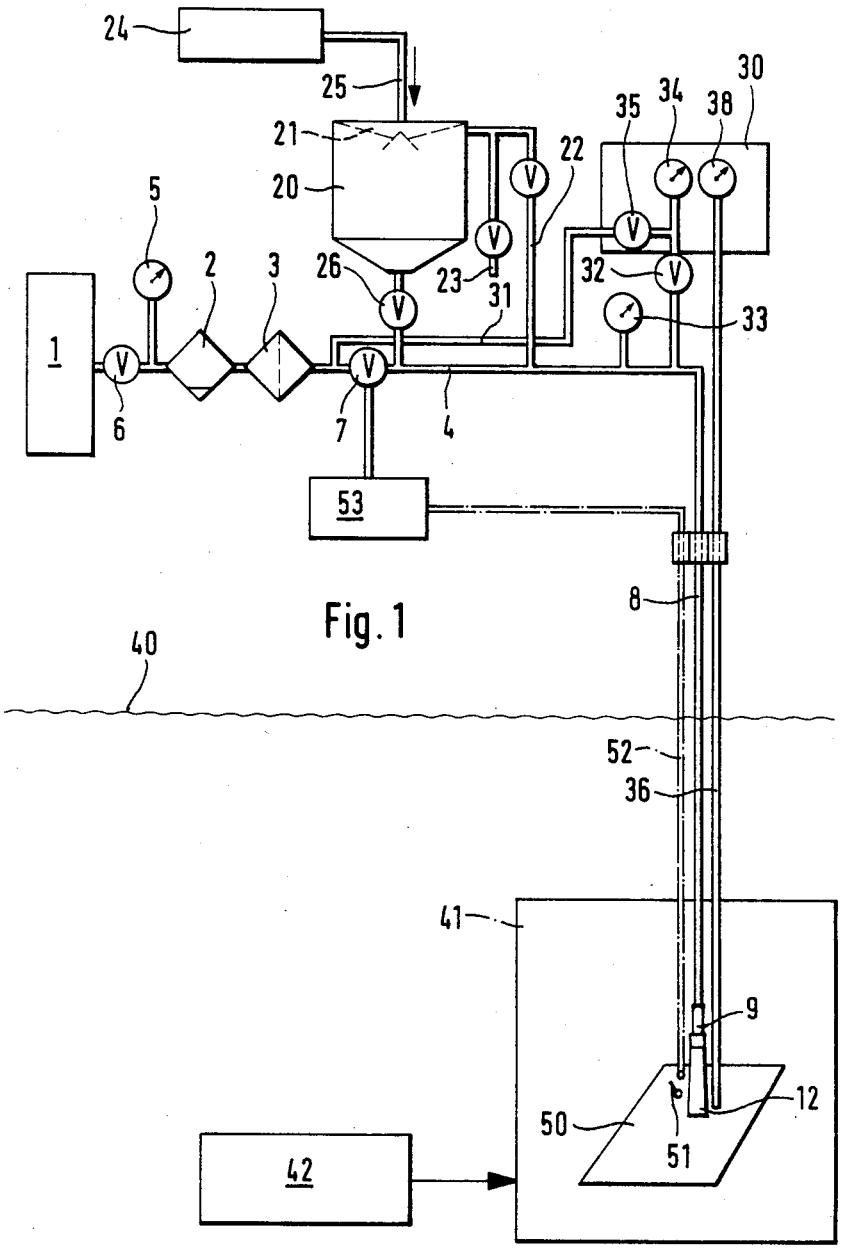
FIG. 1 is a schematic illustration of those structural elements of the inventive device for surface treatment which are located above and below the water surface.

The spray system illustrated in FIG. 1 includes a large proportion of conventional structural elements. These conventional structural elements include a compressor 1 which supplies the compressed-air supply line 4 via a water separator 2 and an air filter 3. A pressure gauge 5 and a shutoff valve 6 are located between the compressor 1 and the water separator 2. Further conventional elements include: the container 20 which contains spray medium and is provided with a closable filling opening 21; a line 22 which is provided with a control valve, pressurizes the spray medium container, and is connected to the supply line 4; and additionally an excess-pressure valve 23. When the filling opening 21 is open, the spray medium to be employed for cleaning, preserving, or coating can be refilled from a storage tank 24 via a supply line 25 or a funnel.

When underwater cleaning is to be performed with the device of the present invention, the spray medium supply or storage tank 24 contains quartz sand, corundum, copper slag, natural or synthetic mineral granules, cork, or the like. For the intended underwater employment, with only a one-time use of the spray means, it is also possible, in contrast to outdoor or open-air spraying, to use such spray media which for the latter cannot be used any more because of danger to the breathing passages of the operator handling the apparatus, or can be used only when taking special protective measures.

Furthermore, the connection of the compressed-air supply line 4 with the spray hose 8, which leads to the work location, is conventional; this spray hose 8 terminates at an outlet nozzle 9, which is preferably a Laval nozzle.

Figure 2:
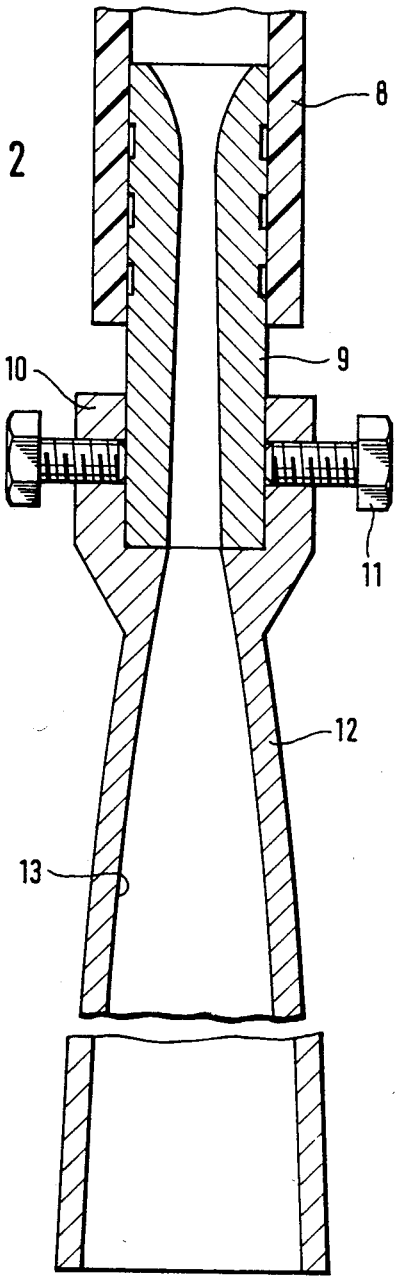
FIG. 2 is a view showing an axial section through the spray medium outlet or discharge nozzle, which is provided with a nozzle adapter or attachment according to the present invention.

A nozzle adapter or attachment 12 is connected to the Laval nozzle 9 as shown in FIG. 2 for the underwater application or use according to the present invention, where the spray hose 8 leads below the water surface 40 to an underwater work location 41 at which a diver 42 is located. A sleeve 10, which serves for fastening of the nozzle adapter 12 overlaps the free end of the nozzle and is held by screws 11 in such a way that it can be detached and replaced. The funnel-shaped nozzle adapter 12 surrounds an elongated parabolic inner space or chamber 13. The length of the adapter 12 corresponds essentially to the required working distance between the Laval nozzle 9 and the surface 50 which is to be treated. By way of example, this length amounts to approximately 250 mm for a nozzle adapter 12 having a 50 mm outlet diameter.

A shunt control 30 is provided pursuant to the present invention to assure that the parts of the device located under water, namely the spray hose 8, the spray nozzle 9, and the spray nozzle adapter 12, remain continually dry and cannot fill with water. The input side of this shunt control 30 is connected via a line 31 to the output side of the air filter 3, and the output side is connected via a control valve 32 with a part of the supply line 4 which is located after the spray medium container 20 when viewed in the direction of flow. The line system via line 31, shunt control 30 and control valve 32 thus bypass that portion of the supply line 4 in which the spray medium is introduced into the supply line 4 via a delivery or charging valve 26.

Accordingly, the possibility exists when the spray medium container is not shut off continually to flush those structural elements of the apparatus which are located under water with a pressurized gas flow, so that no water can penetrate therein. The pressurized gas, which is preferably air, delivered via the shunt into the spray hose 8 must have a pressure which is slightly greater than the water pressure at the work location 41. A control line 36 leads from the shunt 30 to the underwater work location 41 in order to effect automatic pressure adjustment. The pressure detected in the shunt 30 at a pressure gauge 38 directly affects a control valve 35 of the shunt 30, and adjusts the shunt 30 in such a way that a small amount of pressurized air is continually delivered at the spray nozzle adapter 12. As shown in FIG. 1, additional pressure gauges 33 and 34 can be provided in the shunt control 30, which is arranged above water, in order to be able to read the normal working pressure and the reduced pressure in the shunt.

In order that the spray device can be turned off and on by the diver 42 in a very simple manner at the underwater work location 41, a switch 51 is located next to the spray nozzle 9 with which a control unit 53 located above water can be actuated via a signal line 52. The control unit 53 serves to turn on the spray medium supply. In other words, the control unit 53 acts directly on the delivery or charging valve 26 of the container 20 for metering or dosing the spray medium, or, if the valve 26 has a fixed setting, the control unit 53 acts directly on the main shutoff valve 7 of the compressed-air supply line 4. It is also possible to have the control unit 53 act on the shunt 30. However, the shunt 30 is generally left open, so that when the spray medium delivery is turned on and off, no water can penetrate the spray nozzle adapter 12.

Considerably shortened work time and improved surface quality have resulted not only during above-water operation, but also during underwater operation. The following performance data was obtained during underwater operation, for example, in connection with the inventive compressed-air-shunt 30 and the nozzle adapter 12 at a water depth of 10 meters: with a spray surface of approximately 2200 $mm^2$, and at a gas pressure of approximately 9 bar, there was attained a spray performance of 3 $m^2/h$ with a degree of purity of Sa $2\frac{1}{2}$ according to DIN (German Industrial Norm) 55928 part 4, and a peak-to-valley height of 30 $\mu m$.

Thus, as a whole, it can be stated that the device according to the present invention leads to a reliable and economical above-water and underwater working method for treating surfaces in accordance with established standards with a high degree of purity and necessary peak-to-valley height while at the same time considerably increasing the surface area covered per unit of time, and decreasing the smount of spray medium used.

Furthermore, the present invention is in no way restricted to the specific disclosure of the specification and drawing, but also encompasses any modifications within the scope of the appended claims.

We claim:

1. A device for treating the surfaces of structures and ships, even under water, with a spray medium which cleans, preserves, or coats, and is sprayed onto the surface which is to be treated by means of a pressurized-gas flow, said device comprising in combination therewith:

a source of pressurized gas;

an at least partially flexible conduit, which is operatively connected to said source of pressurized gas and leads to a work location for conveying spray-medium-conducting pressurized gas thereto;

an outlet nozzle, in the form of a Laval nozzle, provided at an end of said conduit remote from said source of pressurized gas; and an additional funnel-shaped nozzle adapter attached to said outlet nozzle for effecting delivery of said spray-medium-conducting pressurized gas to said surface which is to be treated; said nozzle adapter additionally having a longitudinally extending, parabolic inner chamber therein, said funnel-shaped nozzle adapter with the longitudinally extending, parabolic inner chamber having considerably higher effectiveness of the spray medium.

2. A device in combination according to claim 1, in which, for use of said device under water, the additional length of said additional funnel-shaped nozzle adapter corresponds essentially to the required working distance between said outlet nozzle and said surface which is to be treated, said additional length amounting to approximately 250 mm for said nozzle adapter having a 50 mm outlet diameter.

3. A device in combination according to claim 2, which includes a source of spray medium operatively associated therewith which is adapted to communicate with said at least partially flexible conduit, and an additional controllable shunt for pressurized gas, said shunt bypassing said source of spray medium, and being provided between said source of pressurized gas and said at least partially flexible conduit, said additional shunt being controlled in such a way that even during times without spray medium supply, said conduit the leads to an underwater work location and said nozzle can be kept dry and free of water due to a relatively small overpressure of pressurized gas conveyed thereto via said shunt to prevent water from entering therein.

4. A device for treating the surfaces of structures and ships, even under water, with a spray medium which cleans, preserves, or coats, and is sprayed onto the surface which is to be treated by means of a pressurized-gas flow, said device comprising:

a source of pressurized gas;

an at least partially flexible conduit, which is operatively connected to said source of pressurized gas and leads to a work location for conveying spray-medium-conducting pressurized gas thereto;

an outlet nozzle, in the form of a Laval nozzle, provided at an end of said conduit remote from said source of pressurized gas;

a funnel-shaped nozzle adapter attached to said outlet nozzle for effecting delivery of said spray-medium-conducting pressurized gas to said surface which is to be treated; said nozzle adapter having a longitudinally extending, parabolic inner chamber, and furthermore, for use of said device under water, the length of said nozzle adapter corresponds essentially to the required working distance between said outlet nozzle and said surface which is to be treated, a source of spray medium which is adapted to communicate with said at least partially flexible conduit, and an additional controllable shunt for said pressurized gas, said shunt bypassing said source of spray medium, and being provided between said source of pressurized gas and said at least partially flexible conduit, said controllable shunt being provided with a control line which leads to said underwater work location, and with a pressure gauge which detects water pressure and keeps pressurized gas delivered by said shunt at a pressure which is greater than the water pressure.

5. A device according to claim 4, which includes, at said underwater work location for delivery of said spray medium, a remote control means which is operatively in communication with said at least partially flexible conduit.

6. In a device for treating the surfaces of structures and ships, even under water, with a spray medium which cleans, preserves, or coats, and is sprayed onto the surface which is to be treated by means of a pressurized-gas flow; said device including a source of pressured gas; an at least partially flexible conduit, which is operatively connected to said source of pressurized gas and leads to a work location for conveying spray-medium-conducting pressurized gas thereto; an outlet nozzle, in the form of a Laval nozzle, provided at an end of said conduit remote from said source of pressurized gas; the improvement in combination therewith comprising:

an additional funnel-shaped nozzle adapter attached to said outlet nozzle for effecting delivery of said spray-medium-conducting pressurized gas to said surface which is to be treated; said additional nozzle adapter having a longitudinally extending, parabolic inner chamber therein, and furthermore, for use of said device under water, the length of said additional nozzle adapter corresponds essentially to the required working distance between said outlet nozzle and said surface which is to be treated.

* * * * *